US006477737B2

(12) United States Patent
Migli

(10) Patent No.: US 6,477,737 B2
(45) Date of Patent: Nov. 12, 2002

(54) SINGLE-PIN HINGE WITH IMPROVED FEATURES

(75) Inventor: Carlo Migli, Lecco (IT)

(73) Assignee: Agostino Ferrari S.p.A.

( * ) Notice: Subject to any disclaimer, the term of this patent is extended or adjusted under 35 U.S.C. 154(b) by 0 days.

(21) Appl. No.: 09/841,331

(22) Filed: Apr. 27, 2001

(65) Prior Publication Data

US 2001/0037539 A1 Nov. 8, 2001

(30) Foreign Application Priority Data

May 5, 2000 (IT) ..... MI000271 U

(51) Int. Cl.[7] ..... E05D 11/10
(52) U.S. Cl. ..... 16/335; 16/336; 16/325
(58) Field of Search ..... 16/335, 336, 325, 16/278, 280, 382, 307

(56) References Cited

U.S. PATENT DOCUMENTS 4,458,379 A * 7/1984 Shelton ..... 16/297
4,716,622 A * 1/1988 DeBruyn ..... 16/297
5,027,474 A * 7/1991 Bowers ..... 16/297
5,604,956 A * 2/1997 Grass ..... 16/277
5,617,612 A * 4/1997 Ferrari et al. ..... 16/278
5,634,242 A * 6/1997 Ferrari et al. ..... 16/335
5,737,804 A * 4/1998 Ferrari et al. ..... 16/242
6,125,508 A * 10/2000 Formenti ..... 16/278

* cited by examiner

*Primary Examiner*—Chuck Y. Mah
(74) *Attorney, Agent, or Firm*—Shlesinger Fitzsimmons Shlesinger

(57) ABSTRACT

A hinge for furniture comprises a bowl (11) adapted to be fastened to a door (12) of a piece of furniture and a wing (13) designed to be fixed to the piece of furniture. The wing has an end (15) which is pivotally mounted to the bowl for rotation relative to the bowl and a spring (17) is received in the bowl, the thrust end (19) of the spring exerting pressure on cam means (20) placed on the wing to move the wing towards a near steady position corresponding to the open or closed hinge position. The spring has a reaction end (21) reacting on the bowl at a rest surface (22) keeping said reaction end (21) oriented in a direction non-parallel to the bowl bottom. Advantageously, the spring reaction end is directed opposite to the bowl bottom and the rest surface (22) is a side wall of the bowl.

8 Claims, 1 Drawing Sheet

SINGLE-PIN HINGE WITH IMPROVED FEATURES

BACKGROUND OF THE INVENTION

The present invention relates to a hinge for furniture, of the single-pin type. In particular, the present invention relates to a hinge of the "frame" type comprising a bowl for fastening to a door and a wing pivotally mounted to the bowl and intended for fixing to a frame of the piece of furniture. A spring is present between the bowl and the wing and it pushes the hinge towards its nearer open or closed position.

Usually the spring is wound around a pin supported in the bowl and has a thrust end acting on the wing and a reaction end acting against the bowl bottom.

There is a problem in these hinges which consists in reaching a sufficient thrust by the spring. An enhancement in the spring efficiency is hindered by the fact that the hinge is required to be maintained within acceptable limits, which does not enable an increase at will of the spring sizes and number of turns forming it (if it is embodied by a double-torsion spring, for example).

It is a general object of the present invention to obviate the above mentioned drawbacks by providing a hinge of the above described general type having improved features. It is a further object to obtain a hinge of more compact sizes without impairing its closing force.

SUMMARY OF THE INVENTION

In view of the above object a hinge for furniture has been conceived, in accordance with the invention, of the type comprising a bowl adapted to be fastened to a door of a piece of furniture and a wing designed to be fixed to the piece of furniture, the wing having an end pivotally mounted to the bowl for rotation relative to the bowl and a spring being received in the bowl, said spring having a thrust end exerting pressure on cam means placed on the wing to move the wing towards a near steady position corresponding to the open or closed hinge position and a reaction end reacting on the bowl, characterised in that the bowl has a rest surface for said reaction end of the spring keeping this reaction end oriented in a direction non-parallel to the bowl bottom.

BRIEF DESCRIPTION OF THE DRAWINGS

For better explaining the innovative principles of the present invention and the advantages it offers over the known art, a possible embodiment applying these principles will be described hereinafter, by way of example, with the aid of the accompanying drawings. In the drawings.

DETAILED DESCRIPTION OF THE INVENTION

Figure 1:
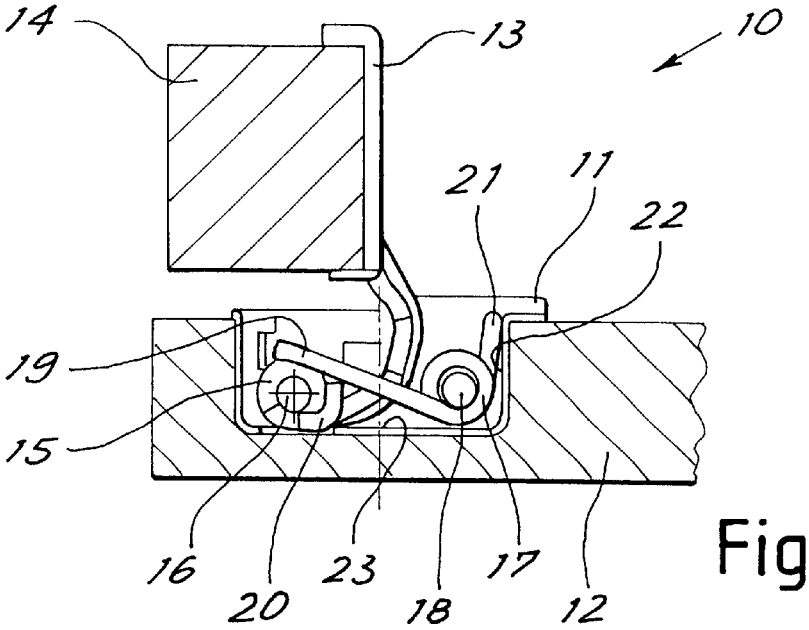
FIG. 1 is a view sectioned along line I—I in FIG. 2, of a hinge made in accordance with the invention, in a closed position.
Figure 2:
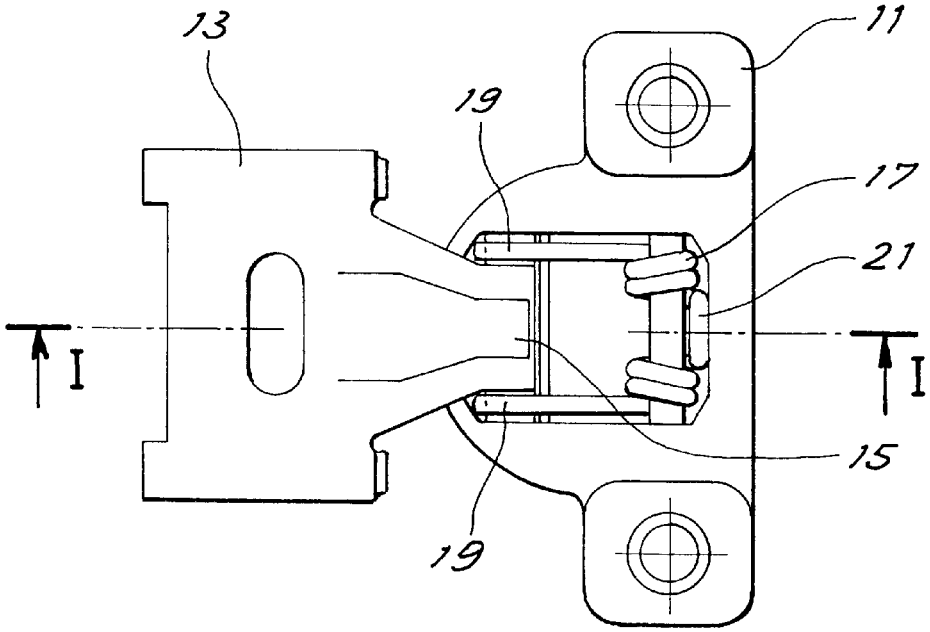
FIG. 2 is a plan view of the hinge in FIG. 1, but in an open position.

With reference to the drawings, a hinge for furniture generally denoted at 10 is shown in FIG. 1; it comprises a bowl 11 adapted to be fastened to a door 12 of a piece of furniture in a recessed position and a wing 13 designed to be fixed to the piece of furniture at a frame 14 thereof. The wing has an end 15 which is pivotally mounted to the bowl 11 at a pin 16 for rotation relative to the bowl. Received in the bowl is a spring 17 having a thrust end 19 thereof exerting pressure on cam means 20 placed on the wing, so as to move the wing towards a near steady position corresponding to the closed (FIG. 1) or open (FIG. 2) position of the hinge. The spring has a reaction end 21 reacting against a surface 22 in the bowl.

The thrust ends of the spring push against the cam means 20 on the pivoting side opposite to the bowl bottom. The surface 22 is capable of maintaining the reaction end 21 oriented in a direction non parallel to the bowl bottom 23.

In particular, the reaction end is advantageously directed opposite to the bowl bottom and the pin 18 is close to such a bottom. The angle formed with the thrust and reaction ends does not exceed 90°.

The spring is advantageously a double-torsion wire spring the reaction end 21 of which is formed of a loop in the wire and the thrust end of which is formed of two free ends 19. Each of the two free ends rests on cam means 20 obtained on the sides of the wing close to its pivotal mounting to the bowl. The spring has a central portion between the thrust and reaction ends which is wound up around a pin 18 supported in the bowl close to its bottom and parallel to the pivotal mounting of the wing in the bowl.

Advantageously, the cam means 20 is made of one piece construction on the wing by appropriate curling of the end sides 15.

Yet advantageously, as clearly shown in the figures, the rest surface of the reaction end of the spring is embodied by the side wall 22 of the bowl and is opposite to the pivotal mounting of the wing, and the pin 18 around which the spring is wound up is close to such a wall.

At this point it is apparent that the intended purposes have been achieved. With the described hinge structure, the spring has a greater efficiency than hinges of the known art. For instance, the described hinge has a spring the efficiency of which is improved by a value greater than 10% as compared with a corresponding hinge having a spring with similar features but resting on the bowl bottom.

In addition, a hinge in accordance with the invention can have greatly smaller sizes than a corresponding hinge of the known art, while keeping a better spring efficiency. For instance, the bowl can be made with a diameter of 26 mm instead of 35 mm. This involves a reduction in costs and a greater number of mounting possibilities.

Obviously, the above description of an embodiment applying the innovative principles of the present invention is given by way of example only and therefore must not be considered as a limitation of the scope of the invention as herein claimed.

For example, the exact conformation and proportions of the different hinge parts can vary depending on specific requirements. In particular, the cam means can either be made as separate parts assembled with the wing or consist of other parts of the wing different from those shown.

What is claimed is:

1. A hinge for furniture, of the type comprising a bowl adapted to be fastened to a door of a piece of furniture and a wing designed to be fixed to the piece of furniture, the wing having an end pivotally mounted to the bowl for rotation relative to the bowl and a spring being received in the bowl, said spring having a thrust end exerting pressure on cam means placed on the wing to move the wing towards a near steady position corresponding to the open or closed hinge position and a reaction end reacting on the bowl, characterized in that the bowl has a rest surface for said reaction end of the spring keeping this reaction end oriented in a direction non-parallel to the bowl bottom, and said spring has a central portion between the thrust and reaction ends which is wound up around a pin supported in the bowl and parallel to the pivotal mounting of the wing to the bowl.

2. A hinge as claimed in claim 1, wherein the reaction end extends in a direction away from the bowl bottom.

3. A hinge as claimed in claim 1, wherein the spring is a double-torsion wire spring having its reaction end formed of a loop in the wire and its thrust end formed of two free ends, each of said free ends resting on said cam means obtained on the sides of the wing close to its pivotal mounting to the bowl.

4. A hinge as claimed in claim 3, wherein the cam means is made of one piece construction with the wing.

5. A hinge as claimed in claim 1, wherein the rest surface of the spring reaction end is embodied by the side wall of the bowl which is opposite to the pivotal mounting of the wing.

6. A hinge as claimed in claim 1, wherein the pin around which the spring is wound up is close to the rest surface of the spring reaction end.

7. A hinge as claimed in claim 1, wherein the thrust and reaction ends extend in directions inclined to each other at an angle that does not exceed 90°.

8. A hinge as claimed in claim 1, wherein the thrust end of the spring exerts pressure on a surface of the cam means at a side thereof opposite to the bowl bottom.

* * * * *